US005622292A

United States Patent [19]

Dorney

[11] Patent Number: 5,622,292

[45] Date of Patent: Apr. 22, 1997

[54] DETACHABLE STRAP FOR A PLASTIC YARD OF ALE

[76] Inventor: Peter Dorney, 159 Dalton Dr., Oviedo, Fla. 32765

[21] Appl. No.: 438,046

[22] Filed: May 8, 1995

[51] Int. Cl.[6] ..... A45F 5/00

[52] U.S. Cl. ..... 224/148.6; 224/148.7; 224/623; 224/901.4; 224/901.8; D3/229

[58] Field of Search ..... 224/148, 202, 224/205, 901; 294/150, 156, 165; D3/229

[56] References Cited

U.S. PATENT DOCUMENTS

| | | | |
|---|---|---|---|
| D. 59,662 | 11/1921 | Lavzon | 224/148 |
| 3,977,582 | 8/1976 | McMahon | 224/901 |
| 4,057,757 | 11/1977 | Darden, Jr. | 224/205 |
| 4,127,223 | 11/1978 | Uchin | 294/150 |
| 4,848,625 | 7/1989 | Lucia | 224/148 |
| 5,407,110 | 4/1995 | Marsh, Jr. | 224/205 |

OTHER PUBLICATIONS

The Journal of the American Medical Association; vol. 168, p. 930, published Oct. 18, 1958.

*Primary Examiner*—Henry J. Recla
*Assistant Examiner*—Gregory M. Vidovich
*Attorney, Agent, or Firm*—Michael J. Colitz, Jr.; Andrew C. Baron

[57] ABSTRACT

A new and improved drinking glass (yard of ale), which uses a flexible detachable strap to support the drinking glass around ones neck for hands free control of the yard. The yard is constructed of plastic as to make it more durable. The strap is of one piece construction which hangs around ones neck as does a necklace. The yard is supported at the bottom, or base, of the strap through the use of a perpendicular overlapping strip of material which adheres through the use of pile type fasteners. The strap is of sufficient length as to give a person the ability to drink from the yard easily, and also let the yard hang from ones neck when released. The yard of ale and strap have decorative imprinted designs and colors, as to make them more attractive to the eye.

1 Claim, 1 Drawing Sheet

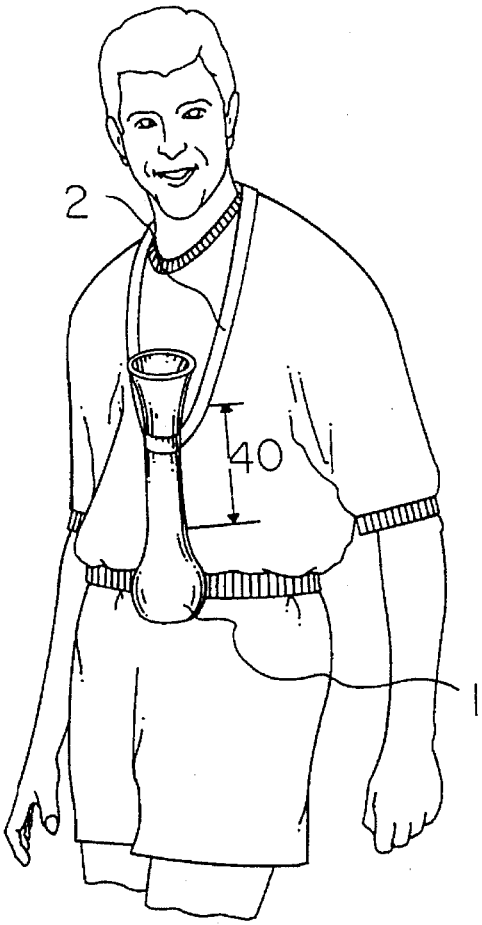
FIG. 1
FIG. 2
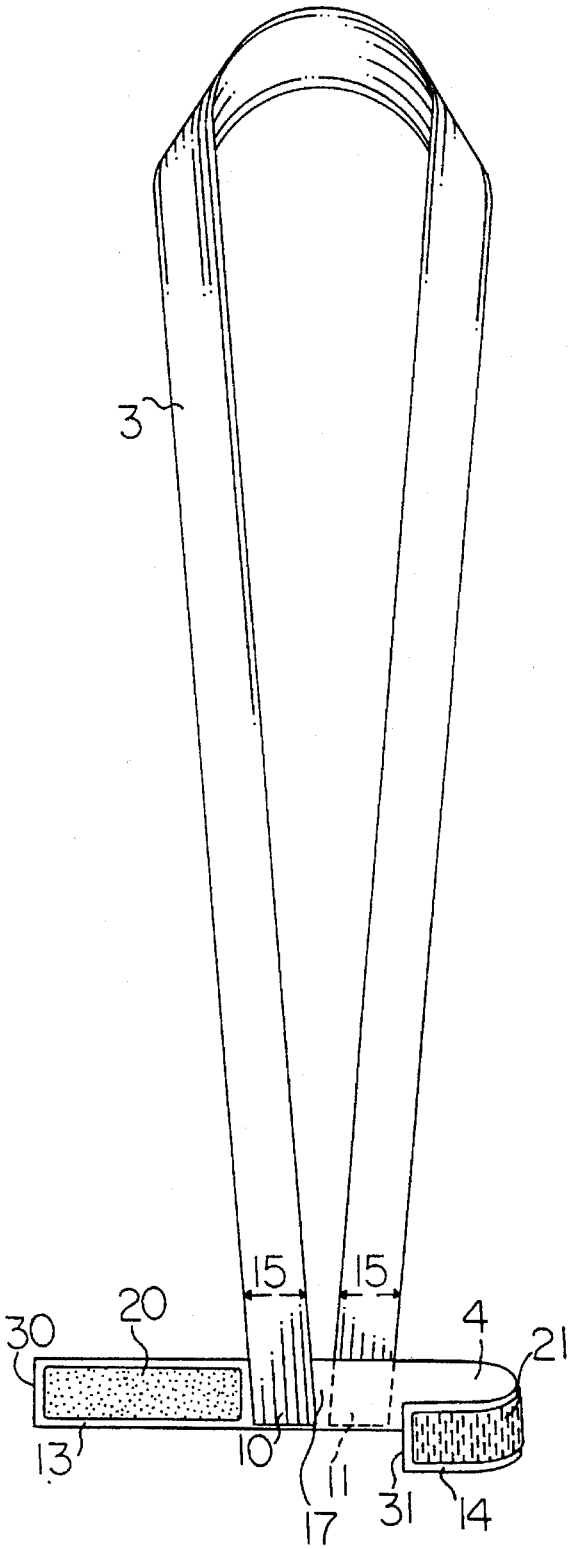

DETACHABLE STRAP FOR A PLASTIC YARD OF ALE

BACKGROUND OF THE INVENTION

The invention relates to a drinking glass structure and a means of supporting the structure. The drinking glass is an English yard of ale which has been around for several years, and is usually accompanied with a wooden stand to help keep the drinking glass from tipping over. Although Yards of Ale are popular, the wooden stands are bulky and awkward. Also, the original glass yards of ale have very thin walls which cause them to break very easily when tipped over. The major disadvantages of the current yard of ale is the fact that it is made of glass, which makes it breakable; and it tips over very easily because of the yards tall slender nature. The present invention constructs the yard of ale from plastic so it is more durable, and utilizes a detachable strap which connects to the body of the glass, so one can hang or carry the Yard around his or her neck, alleviating the problem of tipping over the yard of ale.

DESCRIPTION OF THE PRIOR ART

Currently Yards of Ale are blow molded using glass, which causes the yards to be very fragile and expensive. Because of the yards fanged mouth opening and long slender neck the yard is very unstable when standing on its own. To try and alleviate this problem, a stationary wooden stand was invented. The stand has a slot which the yard slips into, holding it in a stationary position. Also a wooden handle with two clamps, which connects to the neck of the yard was invented. None of these patents for stabilizing or holding the yard appear to be useful for hanging or carrying a plastic yard around ones neck, so the person using the strap has his or her hands free to do other things. Related patents include the following: U.S. Pat. Nos. 2,070,414; 2,617,676; 3,086,806; 3,116,947; 3,177,025; 3,186,544; 3,220,626; 3,311,252; 3,463,536.

SUMMARY OF THE INVENTION

In view of the forgoing disadvantages inherent in the known types of drinking glass structure now present in the prior art, the present invention provides a novel drinking glass wherein the more durable yard of ale is stabilized completely hands free around ones neck. The present invention has a lightweight, flexible and compact strap for use in carrying or hanging a plastic yard of ale around ones neck. The strap can be made of a flexible plastic such as nylon or polypropylene or of leather, but preferably is made of polypropylene. The strap advantageously is of one piece construction, with no assembly of parts required.

The flexible strap includes means for attaching to the plastic yards body preferably through the use of a VELCRO pile type fastener. The strap of this invention provides an easy, comfortable way to carry or hang a plastic yard from ones neck so the yard will be stabilized and ones hands will be free. The flexible strap is of such a length as to form a curved continuous loop which at the base of the strap has a strip of material that will overlap around the yard and remain affixed preferably through the use of a pile type fastener. As such, the general purpose of the present invention, which will be described subsequently in greater detail, is to provide a new and improved novelty drinking glass which has all the advantages of the prior art drinking glass structure and none of the disadvantages. For better understanding of the present invention, its operating advantages and the specific objects attained by its uses, reference should be made to the accompanying drawings and descriptive matter in which there is illustrated preferred embodiments of the invention.

BRIEF DESCRIPTION OF THE DRAWINGS

The present invention will be more fully understood by reference to the following detailed description thereof when read in conjunction with the attached drawings, and herein:

FIG. 1 is a side view of the plastic yard of ale with the detachable strap, sometimes called a party strap of the present invention; and FIG. 2 is a plan view of the detachable strap illustrated in FIG. 1.

DETAILED DESCRIPTION OF THE DRAWINGS

The following description is meant to be illustrative only and is not intended to limit the scope of this invention which is defined solely by the attached claims. With reference now to the drawings. FIG. 1 shows a plastic yard of ale 1 being supported by the flexible detachable strap 2. The detachable strap 2 in FIG. 2 has a main body loop 3 which can be made of nylon, polypropylene, leather, or other flexible plastic, but preferably it is made of polypropylene. The main loop 3 which is 42½ inches in length has a 10½ inch strip 4 of identical material attached to it. The strip of material 4 is attached at the lowest point of the main loop 3 in a perpendicular fashion. The end points 10,11 of the main loop 3 are attached to the strip of material 4 in the center 17 of the strip 4. The left end point 10 of the main loop 3 is attached at the center 17 of the front side 13 of the strip of material 4. The right end point 11 of the main loop 3 is attached at the center 17 of the backside 14 of the strip of material 4. The two end points 10,11 are attached to the center 17 of strip of material 4 in a side by side fashion 15.

The strip of material 4 has pile-type fastener portions 20,21 attached at both ends 30,31 of the strip 4. The male portion of the pile-type fastener portions 20, which is 4 inches in length, spans from the left end point 30 of the frontside 13 to the center 17 of the strip 4. The female portion of the pile-type fastener portions 21, which is also 4 inches in length, spans from the right end point 31 of the backside 14 to the center 17 of the strip 4. The strip of material 4 because of its construction, wraps around the main body 40 of the plastic yard of ale 1. The right end point 31 is wrapped around the main body 40 of the yard of ale 1 first. Then the left end point 30 wraps around the main body 40 of the yard of ale 1 in the opposite direction overlapping the right end point 31 of the strip of material 4. As a result of the placement of the pile-type fasteners 20,21 when the two end points 30,31 are overlapped as described above, the male portion of the pile-type fastener portions 20 will set on top of the female portion of the pile-type fastener portions 21 and become attached, thus securing the detachable strap 2 to the yard of ale 1. Now that the detachable strap 2 is attached to the yard of ale 1 it gives one the ability to hang the yard of ale 1 around ones neck, as in FIG. 1.

As can be seen in the various Figures, the present invention relates to a combination drinking glass and supporting device. Such device includes a drinking glass. The drinking glass is positionable in a generally vertical orientation. The drinking glass has a lower closed end of an increased diameter. The drinking glass also has an upper open end of an increased diameter and a central portion. The central portion has a reduced diameter less than both the diameter of the upper end and the lower end. A supporting strap of a flexible material is provided and has first and second free ends positionable in a generally vertical orientation in front of a wearer. It further has a central portion intermediate the free ends positioned around the back of the neck of a wearer. An intermediate strip is positionable in a generally horizontal orientation. The strip has a first free end and a second free end and a central region between the free ends positionable in a loop with an interior surface and an exterior surface. It further has an upper region and a lower region. The supporting strap has its free ends attached to the opposite surfaces of the intermediate strip adjacent to, but laterally spaced from, the central region. The intermediate strip has a first pile-type fastener on the interior surface adjacent to the first free end and a second pile-type fastener on the exterior surface adjacent to the second free end. The pile-type fasteners are moveable between an inoperative separated orientation and an operative coupled orientation wherein the intermediate strip forms a loop which is unobstructed upwardly and downwardly around the central portion of the drinking glass with the drinking glass extending upwardly from the intermediate strip to a region above the intermediate strip and downwardly from the intermediate strip to a region beneath the intermediate strip.

As to the manner of usage and operation of the instant invention, the same should be apparent from the above disclosure, and accordingly no further discussion relative to the manner of usage and operation of the instant invention shall be provided. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination drinking glass and supporting device comprising, in combination:

a drinking glass positionable in a generally vertical orientation, the drinking glass comprising a lower terminal closed end having a first diameter, an open upper terminal end having a second diameter and a central portion intermediate said upper and lower ends having a third diameter which is less than said first and second diameters;

a flexible support strap having first and second terminal ends which are positionable in a generally vertical orientation in front of a wearer and having a central area intermediate the first and second ends of the strap adapted to be positioned around the neck of the wearer; and an intermediate strip positionable in a generally horizontal position and having first and second free ends and a central region therebetween, said strip further having an interior surface and an exterior surface, said first and second ends of the strap respectively attached to said interior and exterior surfaces of said central region of said strip such that said first and second ends of said strap are laterally spaced from one another, the strip further having a first pile-type fastener on the other of said surfaces on one of said surfaces at one of said ends thereof and a second pile-type fastener on the other of said ends thereof, said pile-type fasteners being movable between an inoperative separated orientation and an operative coupled orientation wherein the intermediate strip forms a loop sized to encircle said central portion of said glass between said upper and lower ends of said glass such that said glass is positioned in a substantially vertical position when supported on the wearer.

* * * * *